US005103511A

United States Patent [19]

Sequin

[11] Patent Number: 5,103,511

[45] Date of Patent: Apr. 14, 1992

[54] OSCILLATORY BED

[76] Inventor: Hector Sequin, 11902 W. Dakota Dr., Lakewood, Colo. 80228

[21] Appl. No.: 487,416

[22] Filed: Mar. 1, 1990

[51] Int. Cl.[5] ..... A61G 7/10

[52] U.S. Cl. ..... 5/607; 5/108

[58] Field of Search ..... 5/62, 61, 108, 109

[56] References Cited

U.S. PATENT DOCUMENTS

| | | | |
|---|---|---|---|
| 459,555 | 9/1891 | Sutton . | |
| 874,555 | 12/1907 | Woollen . | |
| 1,334,042 | 3/1920 | Lopatka . | |
| 1,876,743 | 6/1930 | Pilates . | |
| 2,076,675 | 4/1937 | Sharp | 5/61 |
| 2,113,286 | 2/1936 | White . | |
| 2,613,371 | 6/1950 | Keyes, Jr. . | |
| 3,013,281 | 4/1959 | Steiner . | |
| 3,434,165 | 3/1969 | Keane | 5/62 |
| 3,564,625 | 2/1971 | Danielson . | |
| 3,737,924 | 6/1973 | Davis . | |
| 3,748,666 | 6/1973 | Seng | 5/109 X |
| 3,775,781 | 12/1973 | Bruno et al. . | |
| 3,875,598 | 4/1975 | Foster et al. . | |
| 4,084,274 | 4/1978 | Willis et al. . | |
| 4,114,209 | 9/1978 | Sandlin | 5/62 |
| 4,175,550 | 11/1979 | Leininger et al. | 5/61 X |
| 4,225,988 | 10/1980 | Cary et al. . | |
| 4,270,234 | 6/1981 | James | 5/61 |
| 4,356,577 | 11/1982 | Taylor et al. | 5/62 |
| 4,357,722 | 11/1982 | Thompson | 5/62 |
| 4,441,220 | 4/1984 | Peterson . | |
| 4,658,451 | 4/1987 | Taniguchi . | |
| 4,672,952 | 6/1987 | Vrzalik | 5/61 X |
| 4,752,980 | 6/1988 | Nafte | 5/108 X |
| 4,866,796 | 9/1989 | Robinson et al. | 5/62 |

FOREIGN PATENT DOCUMENTS

| | | | |
|---|---|---|---|
| 210469 | 4/1956 | Australia . | |
| 2626746 | 3/1978 | Fed. Rep. of Germany . | |
| 1554107 | 10/1979 | United Kingdom | 5/62 |

*Primary Examiner*—Renee S. Luebke
*Assistant Examiner*—Michael J. Milano
*Attorney, Agent, or Firm*—Timothy J. Martin; Dana S. Rewoldt

[57] ABSTRACT

An oscillatory bed for a person operates to shift the person's weight in order to eliminate problems associated with convalescence. The bed has a main support frame which receives a cradle frame that is pivotally driven through a cycle about a pivot axis between opposite angular orientations. The cradle frame has side rails, and a support panel has longitudinal side edges fastened along the side rails so that it depends downwardly in an arcuate curvature therebetween. The support panel is constructed of a deformable sheet of stiff, resilient material so that the portion thereof that underlies the person during shifting remains somewhat flat as weight is shifted between the right and left sides of the body. The cradle frame is preferably mounted by trunnions, and a drive wheel is connected to one of the trunnions to be driven by a reversible motor though a gear box and, if desired, a clutch. Limit switches reverse the motor and back-up limit switches are used. The drive is key actuated and includes variable speed controls.

20 Claims, 4 Drawing Sheets

OSCILLATORY BED

FIELD OF INVENTION

The present invention generally relates to beds, but more specifically relates to patient and convalescent beds for the care of persons who have restricted mobility and have limited abilities of movement. In particular, the present invention is directed to patient and convalescent beds which oscillate about a longitudinal axis.

BACKGROUND OF THE INVENTION

There has been a long felt need for improved patient care apparatus in the form of a convalescent bed which helps alleviate various physical and medical problems associated with persons who are confined to a bed for extended periods of time. The difficulties and secondary trauma resulting from such confinement are well documented. Many problems arise when a person's body is in a prone position and is un-moved for extended periods of time. For example, restricted movement of the body can cause blood to pool in lower portions; this pooling of blood can cause life threatening clots. Another significant secondary effect of such restricted movement is that the patient is subjected to a higher risk of pneumonia induced by stagnation of the bodily fluids. Other side effects, while less life threatening, are nonetheless unpleasant at best but potentially quite painful; these side effects include pressure sores (decubiti), other bed sores and kidney stones. Finally, it is not uncommon for persons who have prolonged periods of restricted movement to experience atrophied muscles.

In recognition of these problems, medical personal have long known that, when caring for bed ridden patients, it is necessary to turn the body of the patient periodically so that the weight thereof rests on different longitudinal sectors such as the right side, the left side and the back. The manual turning of a patient is, to say the least, cumbersome since often the patient may not be able to assist the turning operation, in any manner. In a hospital context, the to turn various patients can consume an inordinate amount of nursing care time and, where other emergencies often arise, the turning of a patient can often be delayed or overlooked. In a home care setting, the need to turn the convalescing person or patient from side to side requires almost the continuous presence of care personal which can place increased time pressures on family and friends or significant financial costs for in home medical care.

While there has been some development of mechanical apparatus to facilitate the manual turning of a patient in order to make this process less physically demanding or cumbersome on nursing personal, these turning apparatus commonly comprise articulated beds which have folding panels or sections. Of more interest to the scope of the present invention, however, are those bed constructions which pivot or oscillate about a longitudinal axis so as to shift the convalescing persons weight back and forth between his/her sides.

To this end, it may be helpful to recognize that the concept of a rocking bed, per se, was recognized many years ago in the form of rocking cradles for infants. These devices, however, were directed to mental calming an infant or a child for rest and inducement to sleep; these devices were not developed for purposes of eliminating potential physical trauma to a bed-ridden patient. Such mechanized cradle rocking structures have been taught at least as early as those devices such is shown in U.S. Pat. No. 459,555, issued 15 Sept. 1891, to Sutton and in U.S. Pat. No. 1,334,042 issued 16 Mar. 1920 to Lopatka. The patent to Sutton discloses a spring motor which oscillates a cradle bed along rockers which are supported on a main support frame to provide oscillatory movement for a child placed therein. The Lopatka patent discloses a hemispherical cradle which is spring driven for oscillatory motion to a main frame. In both of these disclosures, however, the structure provided is directed to a temporary rocking motion directed to relaxing a small child placed in the cradle as opposed to eliminating physical trauma as described above.

More germane to the scope of the present invention, though, are those rocking bed structures adapted to adjust the position of a patients body on the bed so as to shift the weight of the convalescing person to different portions of the body. One such example of a tilting bed is described in U.S. Pat. No. 3,013,281 to Steiner issued 19 Dec. 1961. In this patent, a cradle frame provides a rigid mattress support surface which is trough shaped in configuration. The cradle frame may reciprocally pivot about a longitudinal pivot axis. A gear is rigidly affixed to the axle of the cradle frame, and a hand crank drives a worm gear which drives the axle gear thus allowing a care person to manually rock the cradle frame from side to side and thereby shift the weight of the person supported thereon.

Another example of a prior art device is described in U.S. Pat. No. 3,737,924 issued 12 June 1973 to Davis. Here, a hemispherical cradle frame is pivotally journaled to a main frame by oppositely extending trunnions. A rocker arm assembly is interconnected to the cradle frame so that an electrical motor may drive a continuous chain that operates the rocker arm so as to oscillate the cradle frame between opposite angular orientations.

A further example of a prior art device showing an oscillatory patient bed is described in Australian Patent No. 210,469, lodged 5 Oct. 1955, by Cullis. In this Australian patent, a trough shaped bed supports a mattress as a lower flattened section longitudinally extending between a pair of upwardly extending side mattress sections on a wire under mattress. A reversible motor and drive chain assemblies provided, a limit switches are mounted on the underside of the trough shaped cradle to contact limit switches to reverse the direction of rotation of the cradle frame. In this manner, the cradle frame periodically cycles in a forward and reverse direction whereby the body of an invalid placed thereon will be rocked between his/her left and right sides.

Other examples of beds which may be rocked and locked into a desired angle of rotation are shown in U.S. Pat. No. 3,875,598 issued 8 Apr. 1975 to Foster et al and in German Patent No. 2,636,746 issued 30 Mar. 1978 to Malenski. In the Foster et al device, a cradle assembly is freely rotatable about a longitudinal axis, but a brake assembly is provided to lock the cradle against rotation and at a desired orientation. In the patent to Maleski, a trough shaped bed may be pivoted in an oscillatory manner by a motor which drives a worm gear which moves a geared carriage interconnecting the worm gear and the apex of the trough shaped cradle.

Despite the advances made by these various structures, there remains a need for improved bed structures which help eliminate the dangers and difficulties attendant persons who are confined to beds over extended periods of time and who are subjects of restricted movement.

SUMMARY OF THE INVENTION

It is an object of the present invention to provide a new and useful oscillatory bed which may be employed to help prevent or reduce the incidence of physical trauma accompanying convalescing patients.

Another object of the present invention is to provide an oscillatory bed that is simple and practical in construction yet which is attractive in appearance and which may be produced at an economical price so as to be affordable for a variety of applications, both in the medical care field and in the home care field.

A further object of the present invention is to provide a health care bed operative to shift the weight of a person's body onto different longitudinal sectors of the body through a controlled, motor driven drive assembly so as to eliminate a degree of attention necessary from health care personal.

Still a further object of the present invention is to provide an oscillatory bed which has a mattress support surface which is deformable under the weight of the body so as to provide a relatively flattened, horizontal support surface during oscillatory movement thereof.

According to the present invention, then, an oscillatory bed is adapted to support the body of a person during rest and convalescence. The bed oscillates periodically to shift the weight of the body between the left and right sides so that the body is supported along different longitudinal body sectors thereof. The oscillatory bed, in its broad form, includes a main support frame that is positionable on a support surface. A cradle frame is provided and is pivotally journaled to the main support frame for oscillatory movement about a longitudinal pivot axis. The cradle frame includes a pair of longitudinal side rails which are interconnected by a central cradle framework structure such that the side rails are parallel to one another. The side rails thus define a primary plane for the cradle frame. A support panel has one longitudinal side edge fastened to the cradle frame proximate the first side rail and has a second longitudinal side edge fastened to the cradle frame proximate the second side rail so that the support panel is suspended in an arcuate curvature between the first and second side edges thus forming a trough shaped bed member which has panel margins respectively adjacent the side edges and a central panel section extending between the first and second margins. This support panel is constructed as a deformable sheet of stiff yet resilient material. A drive assembly is provided in order to drive the cradle frame in oscillatory movement about a longitudinal pivot axis so that the cradle frame may oscillate between first and second angular orientations wherein the primary plane of the cradle frame is at first and second acute angles with respect to the horizontal. This oscillatory movement is operative to shift support of the body laterally along the support panel back and forth from the first panel margin, across the central panel section to the second panel margin. Accordingly, the weight of the person is reciprocally distributed on the right side of the body central portion of the body and the left side of the body over a cycle of operation. The deformable support panel may deform under the weight of the body placed thereon and, due to the attachment of its edges, the arcuate curvature of the support panel that underlies the body when it is supported will flatten. Naturally, a mattress may be provided to be supported on the support panel, and the person is laid on the mattress to cushion the body with respect to the support panel.

In its more detailed form, the present invention provides a cradle frame that is V-shaped and cross-sectioned including a longitudinal base member that defines a spine for the cradle frame. Pairs of first and second ribs are spaced from one another along the longitudinal base member, and these rib elements are thus organized in to a first set of rib elements and a second set of rib elements that respectively attach and interconnect the first and second side rails to the main support member. End braces may be secured to a head end and a foot end of the cradle frame, and these end braces rigidly mount oppositely extending trunnion shafts at the foot and head of the cradle frame. These trunnion shafts are then rotatably received and pillow blocks in the foot and head portions of the main frame. The main frame foot and head portions in turn, are interconnected by a central beam that underlies the cradle frame. Safety rails may extend upwardly and inwardly from the side rails, if desired, and safety straps may be provided to help secure a persons body in the trough shaped cradle frame.

In order to oscillatory drive the cradle frame, in the preferred embodiment, a motor assembly is mounted in the foot portion of the main frame assembly. Here, a drive wheel is mounted on the foot trunnion shaft and the drive motor assembly turns a drive gear so that a drive chain may mechanically link the drive wheel and the drive gear. An electric motor is provided which is both variable in speed and reversible, and this motor powers, through a gear reduction box, the drive gear. Adjustable limit stops in the form of contact switches are activated upon the turning of the drive wheel which carries contact posts so that, when a selected maximum angular rotation is achieved, a switch is contacted to automatically reverse the motor thus driving it to the opposite angular rotation wherein a switch again reverses the motor. A fail safe stop switch is provided should a selected angular rotation be exceeded, in either direction. As noted, the positioning of the contact posts with respect to the drive wheel may be varied to vary the maximum angular limit stop and, since the motor is variable speed, the period of oscillation may be selectively varied. A key activated on/off switch is provided so that the drive assembly may be key actuated to control operation of the oscillatory bed. The reduction gear assembly is self-locking so that, in a power failure condition, the bed automatically locks into the respective position it is in at the time of power failure. A clutch assembly can release the automatic lock so that the bed can manually be returned to the horizontal and can be otherwise manually positioned during power failures.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to an oscillatory bed which can be reciprocally driven through a cycle of operation at a selectively adjustable periodicity. As such, the present invention is particularly useful for patients who have restricted movement capabilities in order to reduce side effects resulting from a condition of extended periods of bed rest. In its broad form, the present invention includes a main frame that is positionable on a support surface, such as a support floor, a specially constructed cradle frame mounted rotatably journaled to the main frame and a specially constructed drive system for the cradle frame.

Figure 1:
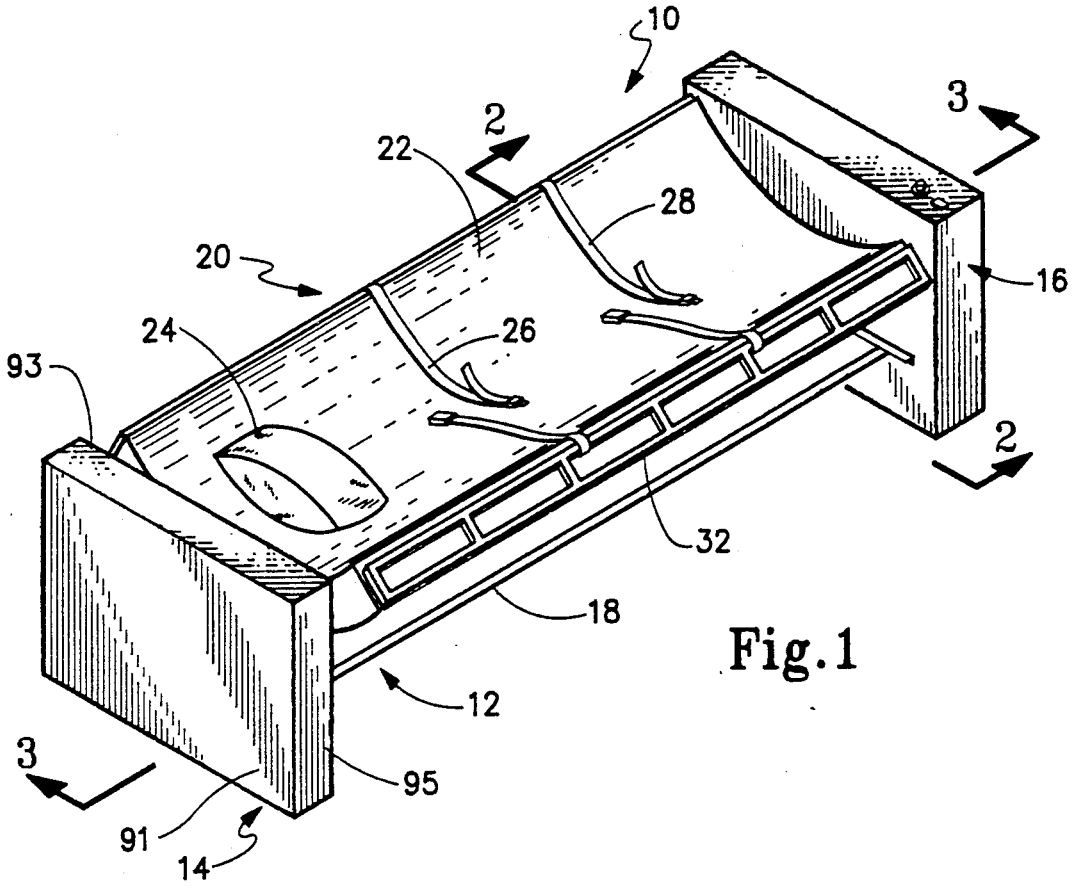
FIG. 1 is a perspective view of the oscillatory bed assembly according to the preferred embodiment of the present invention.

As is best seen in FIG. 1, oscillating bed 10 includes a main support frame 12 having a head frame portion 14 and a foot frame portion 16 which are rigidly connected to one another by means of a longitudinal steel channel beam 18. A cradle frame 20 is pivotally supported by main frame 12 and extends between head frame portion 14 and foot frame portion 16 above beam 18. Cradle frame 20 supports a mattress 22 which, along with pillow 24 can form a bed adapted to receive the body of a person. Adjustable restraining straps 26 and 28 are provided to help hold a person on bed 10.

Figure 2:
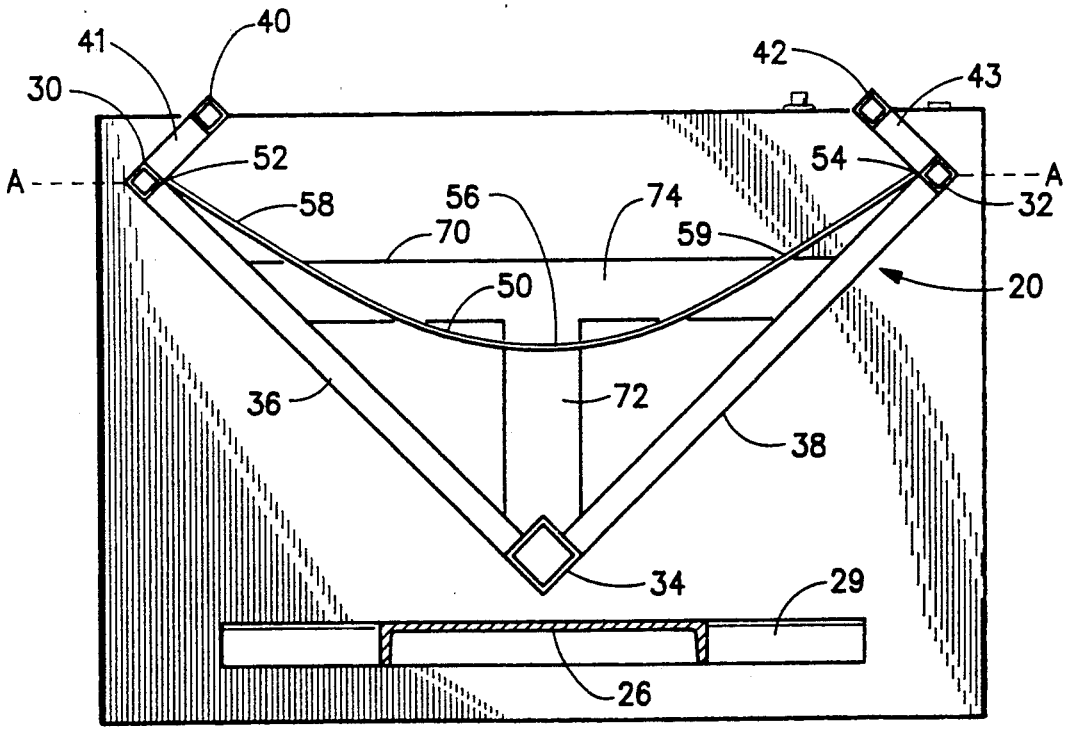
FIG. 2 is a cross-sectional view taken about lines 2—2 of FIG. 1.
Figure 3:
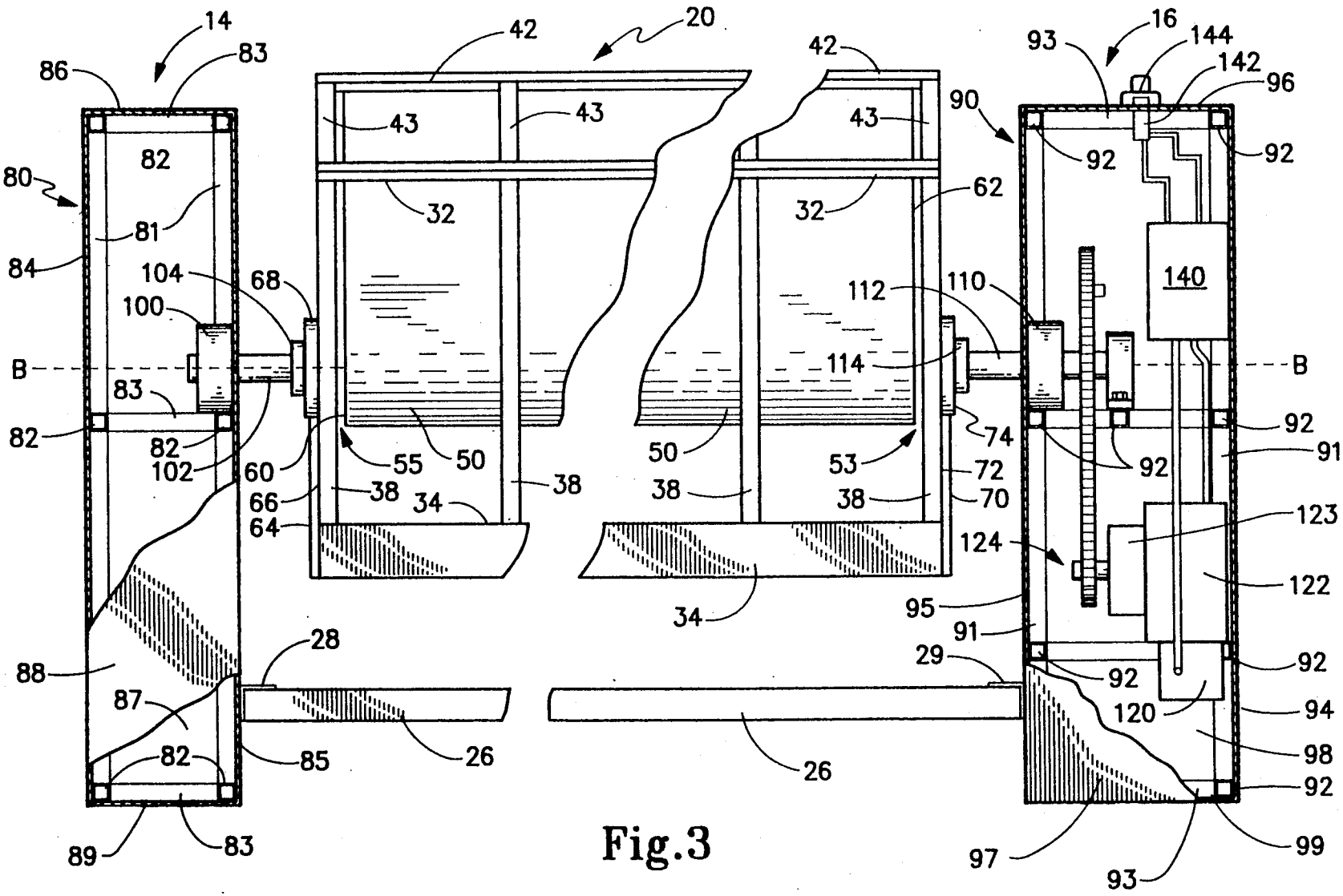
FIG. 3 is a side view in elevation, partially broken away of the oscillatory bed shown in FIG. 1.

The construction of cradle frame 20 according to the exemplary embodiment of the present invention may be seen with greater specificity in FIGS. 2 and 3. Here, it may be seen that cradle frame 20 includes first and second side rails 30 and 32 which are in the form of elongated tubular elements that are parallel to one another to define a cradle frame primary plane A. Side rails 30 and 32 are supported in spaced-apart relation to one another by a central cradle framework that includes a longitudinal base member 34, a plurality first rib elements 36 and a plurality of second rib elements 38. Preferably, base member 34 is formed of a heavy gauge square-shaped steel tube with rib elements 36 and 38 being welded at first ends thereof to base member 34 in perpendicular relation to one another. Thus, rib elements 36 form a first set of rib elements and rib elements 38 form a second set of rib elements. Each of rib elements 36 and 38 are preferably tubular steel having a common square cross-section as side rails 30 and 32. Second ends of rib elements 36 and 38 opposite their respective first ends are welded to side rails 30 and 32 respectively. Further, a first safety rail 40 is connected to first side rail 30 by means of tubular elements 41, and a second safety rail 42 is connected to second side rail 32 by means of tubular elements 43. In the preferred embodiment as shown in FIG. 2, mounting elements 41 and 43 are perpendicularly oriented with respect to their respective rib elements 36 and 38 so that safety rails 40 and 42 are spaced closer to one another than are first and second side rails 30 and 32. It may be appreciated, with reference to FIG. 2, then, that cradle frame 20 has a V-shaped cross-section.

Cradle frame 20 mounts a support panel 50 which defines a bed member operative to support mattress 22. Support panel 50 has a first longitudinal side edge 52 which is fastened to cradle frame 20 proximately to first side rail 30; preferably side edge 52 is connected to side rail 30. Similarly, support panel 50 has a second panel side edge 54 which is fastened to cradle frame 20 proximately to second side rail 40, and preferably directly to side rail 40. Support panel 50 has a foot end 53 and a head end 55 respectively at edges 60 and 62 of panel 50 and that are free spanning so that support panel 50 is therefore freely suspended in a downwardly depending arcuate curvature in V-shaped cradle frame 20 in order to form a trough shaped bed member. This trough shaped bed member has a central longitudinal panel section 56 that is flanked by a first longitudinal support panel margin 58 adjacent panel side edge 52 and a second longitudinal support panel margin 59 adjacent side edge 54. Support panel 50 is constructed of a deformable sheet of stiff, yet resilient metal, such as a medium gauge steel sheet with panel side edges 52 and 54 firmly secured proximate side rails 30 and 32, respectively. Since head end edge 55 and a foot end edge 53 are freely suspended, support panel 50 will readily deform as more thoroughly described below.

In order to further rigidify cradle frame 20, T-shaped end braces are provided on the opposite outermost pairs of rib elements 36 and 38. Thus, as is shown in FIGS. 2 and 3, a head end brace 64 includes a leg section 66 which extends from base member 34 upwardly to terminate in a cross-bar 68 that extends between an outermost end pair of rib elements 36, 38 proximate head frame portion 14. Similarly, a foot end brace 70 includes a leg section 72 which extends upwardly from base member 34 to a cross-bar section 72 which extends between an outermost end pair of rib elements 36, 38 proximate foot frame portion 16. Preferably, the various structural elements of cradle frame 20 are welded to one another with the exception that side edges 52 and 54 of support panel 50 is mounted by metal screws tapped into the respective side rails 30 and 40.

As noted above, cradle frame 20 is rotatably journaled for pivotal motion between head frame portion 14 and foot frame portion 16. To this end, as best shown in FIG. 3, foot frame portion includes a framework 80 of vertical and horizontal tubular members such as vertical members 81, transverse tubular members 82, and longitudinal members 83. This framework 80 is enclosed by panels 84, 85, 86, 87, 88 and 89. Similarly, foot frame portion 16 includes a framework 90 having vertical tubular members 91, horizontal transverse tubular members 92 and horizontal longitudinal members 93. Framework 90 is enclosed by top side and end panels 94, 95, 96, 97, 98 and 99. Head portion framework 80 supports a head pillow block 100 which rotatably receives a head trunnion shaft 102 which is secured to cross-bar section 68 of head end brace 64 by means of a collar 104. Similarly, foot framework 90 mounts a foot pillow block 110 which rotatably receives a foot trunnion shaft 112 which is secured to cross-bar section 74 of foot end brace 70 by means of collar 114. Thus, cradle frame 20 may pivot on trunnion shafts 102, 112 in pillow blocks 100, 110 to define a pivot axis B.

Figure 4:
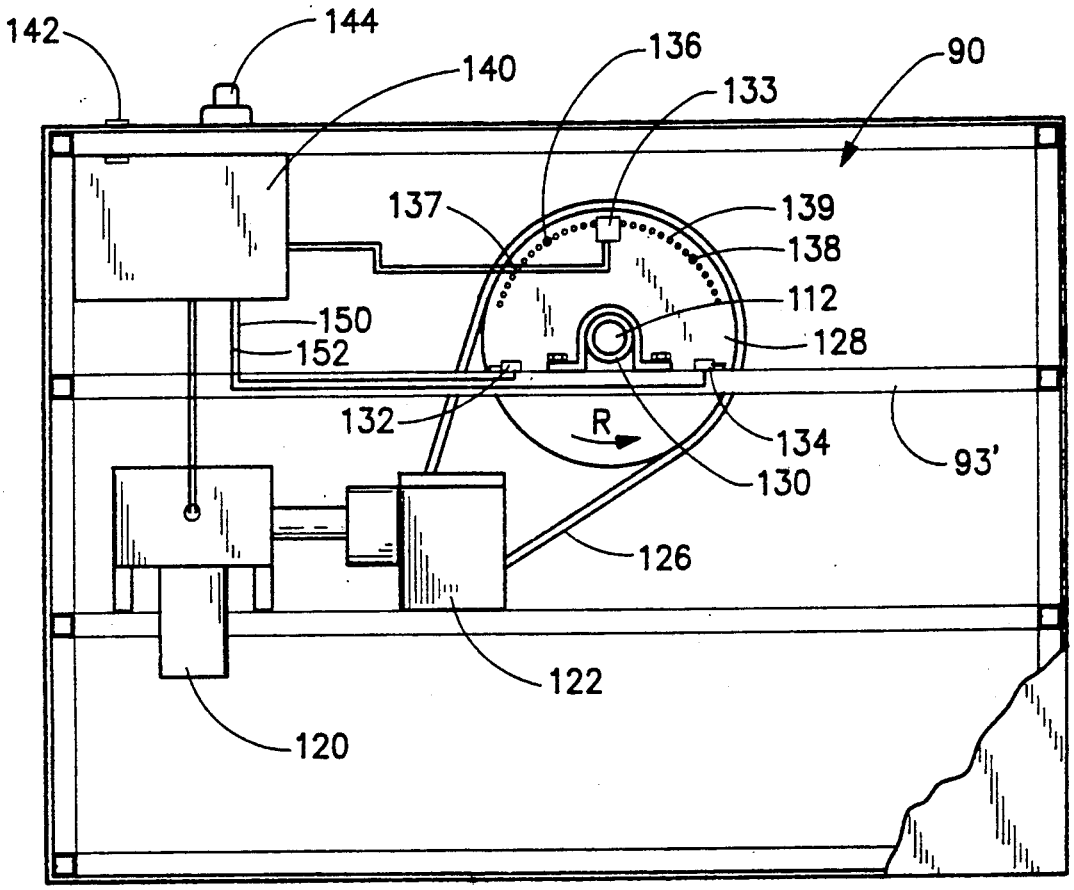
FIG. 4 is an end view in elevation, partially broken away showing the foot portion of the main frame assembly and drive assembly according to the preferred embodiment of the present invention.

In order to drive cradle frame 20 for oscillatory motion, a drive assembly is provided with this drive assembly being best shown in FIGS. 3 and 4. Here, it may be seen that foot end framework 90 mounts a variable speed electric motor 120 that is driveably connected to a reduction gear box 122 that mounts a drive gear 124 through a clutch 123. Drive gear 124 is mechanically linked to a drive wheel 128 by means of a drive chain 126. Drive wheel 128 is attached to foot trunnion shaft 112 which is rotatably received in a mounting bracket 130 so that drive shaft 128 is positioned between bracket 130 and foot pillow block 110. Power to motor 120, which is a reversible, variable speed motor, having a power rating of one-fifteenth horsepower is supplied from a control box 140 that has a key actuated cut-off switch 142, variable control 144 and the associated electronics known in the art. Electric power to control box 140 is received through the traditional electric power cord 141. Key actuated cut-off switch 142 operates to activate and deactivate motor 120, and variable control 144 is a rheostat to vary the speed of motor 120 and thus the rotational speed of drive gear 124. This, correspondingly, varies the speed of drive wheel 128 and the period of oscillation of cradle frame 20. In order to reverse motor 120, a pair of limit switches 132 and 134 are provided on a lateral horizontal frame member 93' shown in FIG. 4. First and second limit posts 136 and 138 are respectively mounted in a selected one of a limit holes 137 and 139 and are oriented so as to contact, respectively, switches 132 and 134. Switches 132 and 134 are electrically connected by means of wires 150 and 152 to control box 140. Fail safe switches 133 provided to disable power to motor 120 through control box 140 in the event switches 132 and 134 fail and the selected maximum angular rotation set thereby is exceeded. Switch 133 can be dual position mercury switch or the like.

The operation of oscillating bed 10 can now be more fully appreciated, from a drive assembly standpoint. After initial activation of motor 120 by key actuated switch 142 and after the speed of motor 120 is set by variable control 144, drive wheel 128 first rotates, for example, counterclockwise in the direction of arrow R shown in FIG. 4. Rotation of drive wheel 128 causes cradle frame 20 to pivot in a counterclockwise direction until limit post 136 rotationally advances to contact limit switch 132. Post 136 activates switch 132 which causes a reversal of drive motor 120 at a maximum angular orientation for cradle, frame 20, and drive wheel 128 then begins to rotate in a clockwise direction. This motion continues until cradle frame primary plane A passes through the horizontal and is angularly rotated to a second maximum angular orientation occurring when limit post 138 contacts limit switch 134. Activation of switch 134 by post 138 again causes reversal of motor 120 and the cycle repeats. It should be appreciated that the selected mounting of post 136 in a selected hole 137 and a selected mounting of post 138 in a selected hole 139 allows for selective adjustment of the maximum angle of rotation of cradle frame 20.

Figure 5A:
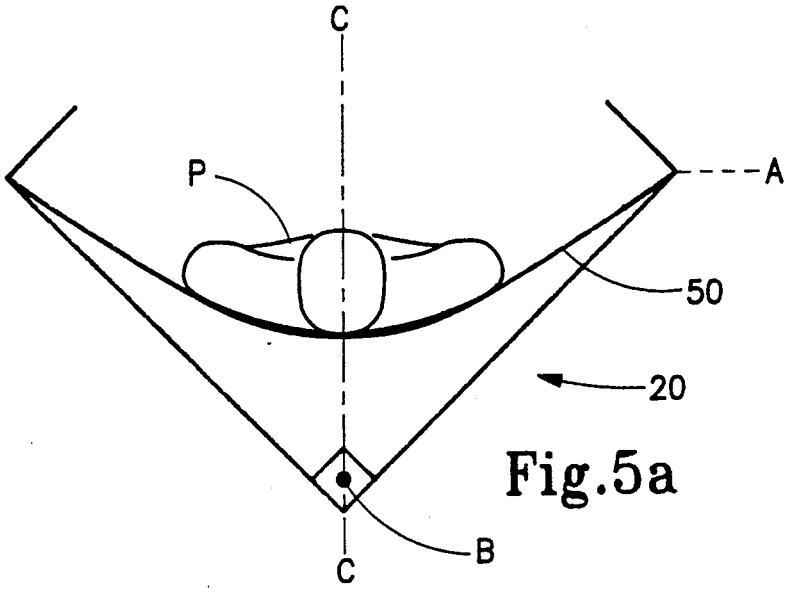
FIGS. 5a–5c are diagrammatic views, in cross-section showing the angular oscillatory motion of the bed according to the preferred embodiment of the present invention over a cycle of angular movement thereof.
Figure 5B:
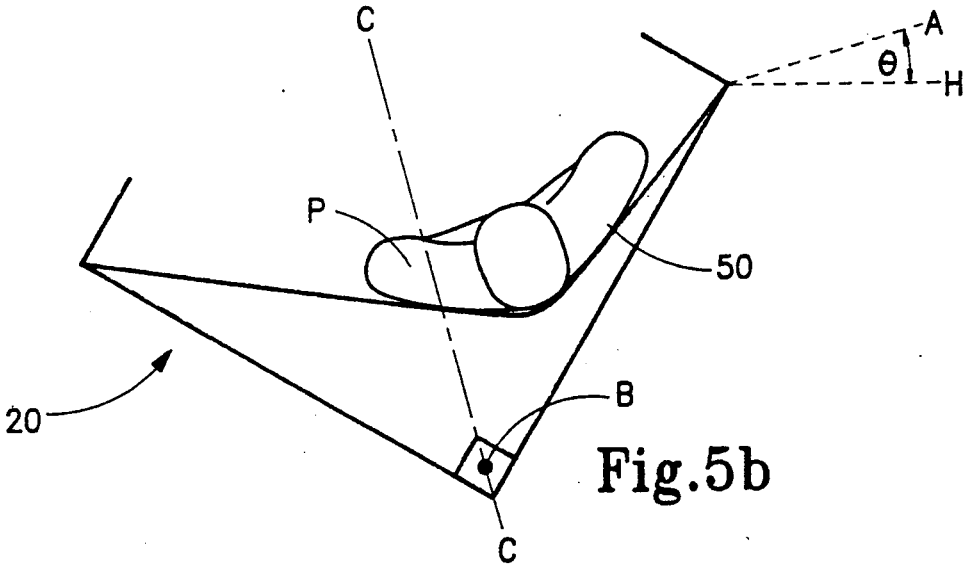
Figure 5C:
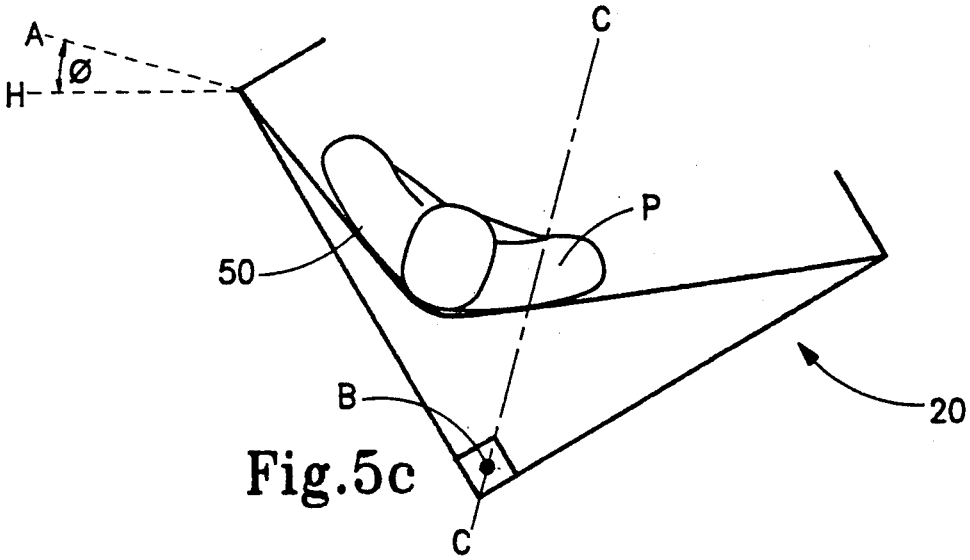

Turning, then, to FIGS. 5*a*–5*c*, a cycle of motion of cradle frame 20 may be seen in diagrammatic form. As is shown in FIG. 5*a*, cradle frame 20 is in a medial position wherein primary cradle frame A is horizontal. Support panel 50 is symmetric about a reference plane C that is perpendicular to plane A and which contains pivot axis B. As drive wheel 128 rotates in a counterclockwise direction, cradle frame 20 moves to a maximum first angular orientation shown in FIG. 5*b* wherein it may be seen the support panel 50 is now asymmetric with respect to reference plane C due to its ability to deform. In this first maximum angular orientation, plane A is oriented at an acute angle $\theta$ with respect to the horizontal with this angle $\theta$ being defined as the limit set by the position of limit post 138 in holes 139. Here, person P is on the left side of the body. When drive motor 120 reverses, cradle frame 20 returns first through the medial position shown in FIG. 5*a*, with person P on his/her back, to a second maximum angle orientation shown in FIG. 5*c* wherein cradle plane A is at an acute angle $\phi$ with respect to the horizontal with the maximum angle $\phi$ being selectively adjusted by the positioning of post 136 in holes 137. In this second angular orientation, again it may be seen that support panel 50 is asymmetric with respect to reference plane C due to its deformability, and person P is supported on the right side of the body. Further, while it is usually desired for acute angles $\theta$ and $\phi$ to be equal in magnitude but opposite with respect to angular rotation, it is possible that different magnitudes for angles $\theta$ and $\phi$ be employed by the respective positioning of posts 136 and 138.

It can now be appreciated that, when a person P is placed on mattress 124 supported by support panel 50, the person will be rocked back and forth due to the cyclical motion of cradle frame 20. As a result of the deformability of support panel 50, it may be seen that the portion of the support panel which underlies the person during this motion will be flattened as the person is rolled from the right shoulder wherein the persons body is supported by margin 58, through the medial position wherein the persons body is supported by central section 56 to the right shoulder wherein the person is supported by margin 59. This motion has a period which has is preferably approximately thirty minutes but may be selectively varied by variable control 144. In the event of power failure, motor 120, and reduction gear box 122 are self locking so that cradle frame 20 will lock into the angular orientation corresponding to the angle of reference plane A with the horizontal at the time of power failure. Where it is desired to unlock cradle frame 20 during power failure, clutch 123 may be manually released to allow cradle frame 20 to pivot on trunnion shafts 102 and 112.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An oscillatory bed adapted to support the body of a person during rest and operative to periodically shift the weight of the body between the right and left sides of the body, comprising:

a main support frame positionable on a support surface;

a cradle frame having a cradle foot end and a cradle head end and including a foot brace member rigidly attached to said cradle frame at said foot end and a head brace member rigidly attached to said cradle frame at said head end wherein said foot brace member and said head brace member rigidify said cradle frame, said foot brace member and said head brace member pivotally journaled to said main support frame for oscillatory movement about a longitudinal pivot axis, said cradle frame including first and second longitudinal side rails and a central cradle framework interconnecting said first and second side rails, said first and second side rails parallel to one another to define a cradle frame primary plane;

a support panel having a first panel side edge fastened to said cradle frame along said first side rail and a second panel side edge fastened to said cradle frame along said second side rail, said support panel suspended in an arcuate curvature between said first and second side edges to form a trough-shape so that said support panel has first and second longitudinal panel section between said first and second panel margin sections, said support panel constructed as a deformable sheet of still yet resilient material; and drive means for driving said cradle frame in oscillatory movement about the pivot axis so that said cradle frame oscillates from a first angular orientation wherein the cradle frame primary plane is at a first acute angle with respect to horizontal, through a medial orientation wherein the cradle frame primary plane is horizontal, to a second angular orientation wherein the cradle frame primary plane is at a second acute angle with the horizontal, the oscillatory movement operative to shift support of the body laterally along said support panel back and forth from the first panel margin section, the central panel section and the second panel margin section so that the weight of the person is reciprocally distributed on the right side of the body, a central portion of the body and the left side of the body.

2. An oscillatory bed according to claim 1 wherein said cradle frame has a reference plane that contains the pivot axis and that is perpendicular to the primary axis, said support panel being symmetric about the reference plane when said cradle frame is in the medial orientation and asymmetric about the reference plane when said cradle frame is in the first and second angular orientations.

3. An oscillatory bed according to claim 2 wherein said support panel deforms under the weight of a body placed thereon such that the arcuate curvature of a support portion thereof that longitudinally underlies the body is laterally moved thereacross.

4. An oscillatory bed according to claim 1 including a deformable mattress means supported on top of said support panel for cushioning the body of the person placed thereon.

5. An oscillatory bed according to claim 1 wherein said cradle frame is V-shaped in cross-section and includes a longitudinal base member defining a spine for said cradle frame, a first set of first rib elements having first rib first ends attached to said base member and first rib second ends attached to and supporting said first rail, and a second set of second rib elements having second rib first ends attached to said base member and second rib second ends attached to and supporting said second rail, said first set of first rib elements and said second set of second rib elements upwardly divergent from said base member to define a V-shaped region within said cradle frame, said support panel being located within said region and freely spanning the region from said first side rail to said second side rail.

6. An oscillatory bed according to claim 5 wherein each said first rib element is paired with a respective said second rib element to define a rib pair such that a plurality of rib pairs are formed and are longitudinally spaced at selected intervals along said base member.

7. An oscillatory bed according to claim 5 wherein said first set of first rib elements are perpendicular to said second set of second rib elements.

8. An oscillatory bed according to claim 7 wherein said first side rail has a first safety rail connected to said first side rail and wherein said second side rail has a second safety rail connected to said second side rail, said first and second safety rails spaced closer to one another than said first and second side rails.

9. An oscillatory bed according to claim 8 including a foot trunnion and a head trunnion extending oppositely one another and respectively outwardly from said foot and head brace members, said foot and head trunnions defining said pivot axis.

10. An oscillatory bed according to claim 9 wherein said main support frame includes a foot frame portion and a head frame portion connected together, and including a foot and head pillow blocks respectively mounted in said foot and head frame portions and operative to pivotally receive said foot and head trunnions, respectively.

11. An oscillatory bed according to claim 1 including at least one restraining strap releasably connectable across said cradle frame between said first and second side rails.

12. An oscillatory bed according to claim 1 wherein said drive means includes first and second limit stop means for limiting to a maximum limit the acute angle of said first and second angular orientations respectively.

13. An oscillatory bed according to claim 12 including backup limit stop means operative to disable said drive means should the maximum limit be exceeded by a selected amount.

14. An oscillatory bed according to claim 1 including a key actuated start switch operative to enable and disable said drive means.

15. An oscillatory bed adapted to support the body of a person during rest and operative to periodically shift the weight of the body between the right and left sides of the body, comprising:

a main support frame including a head portion, a foot portion and a main longitudinal beam interconnecting said head and foot portions, said main support frame positionable on a support surface;

a cradle frame of V-shaped configuration having a cradle foot end and a cradle head end and including a longitudinal base member defining a spine, a first side rail interconnected to said base member by a first side framework including a plurality of first rib elements interconnecting said base member and said first side rail at spaced locations along said first side framework from said cradle foot end to said cradle head end and a second side rail interconnected to said base member by a second side framework including a plurality of second rib elements interconnecting said base member and said second side rail at spaced locations along said second side framework from said cradle foot-end to said cradle head end whereby said first and second side frameworks form the V-shaped configuration of said cradle frame such that said first and second side rails are spaced apart from one another to define a cradle frame primary plane, and including a head trunnion and a foot trunnion oppositely projecting from one another to define a pivot axis, said head and foot trunnions rotatable journaled in respective pillow blocks mounted in said head and foot portions of said main support frame whereby said cradle frame may be oscillated between a first angular orientation and a second orientation;

a support panel having a first panel side edge fastened to said cradle frame along said first side rail and a second panel side edge fastened to said cradle frame along said second side rail, said support panel suspended in an arcuate curvature between said first and second side edges to form a trough-shape bed surface so that said support panel has first and second longitudinal panel margin sections respectively adjacent said first and second panel side edges and a central longitudinal panel section between said first and second panel margin sections, said central longitudinal panel section located proximate said pivot axis whereby said body of a person during rest lies substantially co-extensive with the pivot axis, said support panel constructed as a deformable sheet of stiff yet resilient material; and drive means including a reversible motor for driving said cradle frame in oscillatory movement about the pivot axis so that said cradle frame oscillates from the first angular orientation wherein the cradle frame primary plane is at a first acute angle with respect to the horizontal, through a medial orientation wherein the cradle frame primary plane is horizontal, to the second angular orientation wherein the cradle frame primary plane is at a second acute angle with the horizontal, said drive means including limit stop switch means for reversing the motor at said first maximum angular orientation and second maximum angular orientation whereby the cradle frame is placed in oscillatory movement operative to shift support of the body laterally along said support panel back and forth from the first panel margin section, the central panel section and the second panel margin section so that the weight of the person is reciprocally distributed on the right side of the body, a central portion of the body and the left side of the body.

16. An oscillatory bed according to claim 15 wherein said drive means includes a drive wheel mounted on said foot trunnion whereby oscillatory movement of said drive wheel correspondingly oscillates said cradle frame with respect to said main support frame, a drive motor assembly having a drive gear and a drive belt means interconnecting said drive gear and said drive wheel for oscillating said drive wheel in response to oscillatory rotation of said drive gear.

17. An oscillatory bed according to claim 15 wherein said drive means includes a gear reduction assembly mechanically driven by said electric motor, said gear reduction assembly operative to lock said cradle frame in a locked position when said electric motor is disabled.

18. An oscillatory bed according to claim 17 including a clutch assembly means for mechanically releasing said cradle frame from the locked position.

19. An oscillatory bed according to claim 15 including means for varying the speed of said electric motor whereby the period of oscillation of said cradle frame may be selectably varied.

20. An oscillatory bed adapted to support the body of a person during rest and operative to periodically shift the weight of the body between the right and left sides of the body, comprising:

a main support frame having a head portion and a foot portion and positionable on a support surface;

a cradle frame having cradle head end and foot end and pivotally journaled to said main support frame for oscillatory movement about a longitudinal pivot axis, said cradle frame including first and second longitudinal side rails and a central cradle framework interconnecting said first and second side rails, said first and second side rails parallel to one another to define a cradle frame primary plane;

a support panel constructed as a deformable unitary sheet of stiff yet resilient material having a head end edge located adjacent the cradle head end and a foot end edge located adjacent the cradle foot end so that said support panel extends continuously from a first location proximate the cradle head end to a second location proximate the cradle foot end, said support panel having a first panel side edge fastened to said cradle frame along said first side rail and a second panel side edge fastened to said cradle frame along said second side rail, said support panel suspended in an arcuate curvature between said first and second side edges to form a trough-shaped so that said support panel has first and second longitudinal panel margin sections respectively adjacent said first and second panel side edges and a central longitudinal panel section between said first and second panel margin sections; and drive means for driving said cradle frame in oscillatory movement about the pivot axis so that said cradle frame oscillates from a first angular orientation wherein the cradle frame primary plane is at a first acute angle with respect to horizontal, through a medial orientation wherein the cradle frame primary plane is horizontal, to a second angular orientation wherein the cradle frame primary plane is at a second acute angle with the horizontal, the oscillatory movement operative to shift support of the body laterally along said support panel back and forth from the first panel margin section, the central panel section and the second panel margin section so that the weight of the person is reciprocally distributed on the right side of the body, a central portion of the body and the left side of the body.

* * * * *